United States Patent [19]

Kambic

[11] Patent Number: 4,562,664

[45] Date of Patent: Jan. 7, 1986

[54] DOOR POSITION MONITOR WITH AUTOMATIC ADJUSTMENT

[75] Inventor: Raymond V. Kambic, Joliet, Ill.

[73] Assignee: R. R. Brink Locking Systems, Inc., Plainfield, Ill.

[21] Appl. No.: 560,156

[22] Filed: Dec. 12, 1983

[51] Int. Cl.[4] ..... G08B 13/08

[52] U.S. Cl. ..... 49/14; 49/15; 74/531; 200/61.62

[58] Field of Search ..... 49/14, 13, 15; 74/531; 200/61.62, 61.7

[56] References Cited

U.S. PATENT DOCUMENTS

| | | | |
|---|---|---|---|
| 1,531,107 | 3/1925 | Larson | 49/14 X |
| 1,604,209 | 7/1924 | Wenzel | 49/14 X |
| 3,145,276 | 8/1964 | Brown et al. | 200/61.62 |
| 3,832,804 | 9/1974 | Goldsmith | 49/13 |
| 3,973,357 | 8/1976 | Kluempers | 49/13 |
| 3,987,687 | 10/1976 | Bland et al. | 74/531 |
| 4,334,388 | 6/1982 | Kambic | 49/14 |

*Primary Examiner*—Philip C. Kannan

*Attorney, Agent, or Firm*—Trexler, Bushnell & Wolters, Ltd.

[57] ABSTRACT

There is disclosed a door position monitoring assembly for a security door installation wherein the assembly can be adjusted and preset from the exterior of the assembly. In this regard, the monitoring assembly includes a base member with switching means carried by the base member and capable of being operated to attain a first condition and a second condition, each of which conditions can be detected by suitable circuit means. A control arm produces operation of the switching means and has one end thereof coupled for movement with said door and the other end piotally mounted to the base member. An actuator means is provided for operatively coupling said pivotally mounted end of the control arm with the switching means such that when the door is open said switching means will be in said first condition, rotation of said control arm upon movement of the door to a substantially closed position producing said second condition of said switching means and initial movement of the door away from said substantially closed position permitting said switching means to return to said first condition, so that very slight opening movement of the door can be detected. The actuator means further includes self-aligning means positionable prior to installation of said monitoring assembly for automatically presetting and adjusting said actuator means from the exterior of the assembly to assure proper operation thereof in conjunction with any given door installation without regard for variations in the door installations.

14 Claims, 8 Drawing Figures

106
100
104
99
98
96
76
94
90
78
92
88
86
80
62
71
64
52
54
102
72a
84
72
46
74

DOOR POSITION MONITOR WITH AUTOMATIC ADJUSTMENT

BACKGROUND OF THE INVENTION

The present invention relates to a monitored, controlled door installation, such as the type employed in penal institutions or the like and more specifically, to an improved door position monitoring arrangement including novel structure for automatically adjusting or aligning the monitoring arrangement for operation with a given degree of door movement from the secured or closed position.

Penal institutions or the like often employ monitoring and control apparatus for cell doors or the like. Accordingly, when it is desired to control access to a number of doors at any one time, it is desirable that a display panel or the like provide a correct indication as to the open or closed condition of each of the doors to be controlled. To attain the desired monitoring of the status of each door, various types of apparatus are used, which are responsive to door position and capable of providing a control signal in relation thereto.

In this regard, the prior art has provided a door lock mechanism which generally includes a monitoring switch which is operated from a first or "door-open" position to a second or "door-closed" position when the door is fully closed. When the door is open or ajar slightly, however, these switches and the lock mechanism are often accessible and hence can be operated manually to give a false signal that the door is closed and locked, when in fact it is not.

To augment this type of lock monitoring arrangement, it is a relatively common practice to employ a second door position monitor that cannot be easily circumvented. The respective door position monitors are then connected essentially in series circuit with a display panel so that a "door secure" signal is provided only when both monitors detect the closed position of the door. As such, ideally the second monitoring arrangement should be of a type that will give the "door secure" signal only when the door is substantially at the fully, and completely closed position. In this condition, the engagement of the door with the door stop and its alignment with the door jamb preclude manual overriding of the lock apparatus and the monitoring switch associated therewith.

One type of known secondary or supplemental monitoring arrangement employed in the art provides a switch which is associated with a hinge-type actuator, and is operated as a result of the pivotal movement of the door about the axis provided by the door hinges. The problem with this arrangement, however, is that the sensitivity of available switch designs is such that a certain minimum amount of movement of the operating arm for the switch is required before the switch is operated from one condition to another.

Since the operational movement for the switch is produced as a result of the pivotal movement of the door at the hinge, there exists with these prior art arrangements, a considerable play or range of arcuate movement of the door at the outer edge thereof that can take place when the door is moved before the switch is actuated. It will be appreciated in this regard that but a few degrees of movement of the door at the hinge will often result as much as one or two inches of movement of the free edge of the door at the door jamb proximate the lock. Openings of this size can be sufficient to enable manual overriding of the lock and the monitoring switch associated therewith so that the display panel may register a "door secure" condition when in fact a door is ajar and not secured.

One particularly advantageous system for overcoming the foregoing problem is shown in my prior U.S. Pat. No. 4,334,388. This arrangement attains sensitivity of operation through the arrangement and construction of the various elements of the overall assembly, while using conventional switch components. More specifically, with the prior art type of monitoring arrangements as discussed above, the ratio of door movement to movement available for operation of the monitoring switch was 1:1; that is, one degree (1°) of door movement produced but one degree (1°) of rotational movement about the hinge axis for transmittal to the switch actuating mechanism. In contrast, the arrangement provided in my aforesaid patent increases this ratio by moving the operational pivot for the switch actuating mechanism away from the pivotal axis of the door as defined by the hinges, and by connecting the pivotally mounted door to said actuating mechanism by a control arm which is slidably connected to the door, yet will pivot relative to the switch actuating mechanism. As is detailed more fully in the aforesaid patent, a ratio of actuator movement to door movement of 1.55:1 is easily attained. Thus, by way of example, with the prior art two degrees (2°) of door travel will result in only two degrees (2°) of rotational movement at the hinge axis, approximately three degrees—five minutes (3°—5′) of actuator movement is obtained.

While the foregoing patented system has proved successful there is room for yet further improvement. For example, the patented system requires some final adjustment during installation to "fine tune" the monitoring assembly for operation with a particular door and door frame.

The present invention advantageously eliminates the need for any particular skill or experience on the part of the installer, by greatly simplifying the installation procedure in this regard. That is, the present invention presents an automatically adjustable or self-aligning feature which eliminates the need for such "fine tuning" or fine adjustments upon installation.

OBJECTS AND SUMMARY OF THE INVENTION

Accordingly, it is a general object of the invention to provide a novel and improved door position monitoring assembly.

A more specific object is to provide a monitoring assembly in accordance with the foregoing object which is further capable of automatic adjustment or alignment to accommodate the operation thereof with any given door installation, without requiring any special skills or experience on the part of the installer.

A related object is to provide a door position monitoring assembly in accordance with the foregoing objects which is relatively simple and inexpensive in its manufacture, simple to install, and yet highly reliable in operation.

Briefly, and in accordance with the foregoing objects, a door position monitorng assembly is provided for a security door installation including a door having a vertical edge hingedly mounted to a door frame. The door position monitoring assembly in accordance with the invention includes switching means mountable to a stationary horizontal surface of the door installation such as the door frame or the threshold. The switching means is capable of being operated to attain a first condition and a second condition, each of which conditions can be detected by suitable circuit means. A control arm has one end thereof coupled for movement with the door; and pivot means pivotally mounts the control arm proximate the other end thereof, such that movement of the door upon the hinged mounting thereof will produce pivotal movement of the control arm. Actuator means operatively couples said pivotally mounted end of the control arm with said switching means such that when the door is open, the switching means will be in a first condition, with rotation of the control arm upon movement of the door to a substantially closed position producing the second condition of the switching means, and initial movement of the door away from the substantially closed position permitting the switching means to return to the first condition. In accordance with the invention, the actuator means includes self-aligning means which are initially positionable prior to installation of the monitoring assembly, and upon the final installation thereof automatically preset the actuator means to attain the desired positional alignment of the actuator means and the control arm thereby to assure operation thereof in conjunction with door movement without regard for variations in the security door installation.

BRIEF DESCRIPTION OF THE DRAWINGS

The features of the present invention which are believed to be novel are set forth with particularity in the appended claims. The organization and manner of operation of the invention, together with further objects and advantages thereof, may best be understood by reference to the following description taken in connection with the accompanying drawings in which like reference numerals identify like elements and in which:

DETAILED DESCRIPTION OF THE ILLUSTRATED EMBODIMENT

Figure 1:
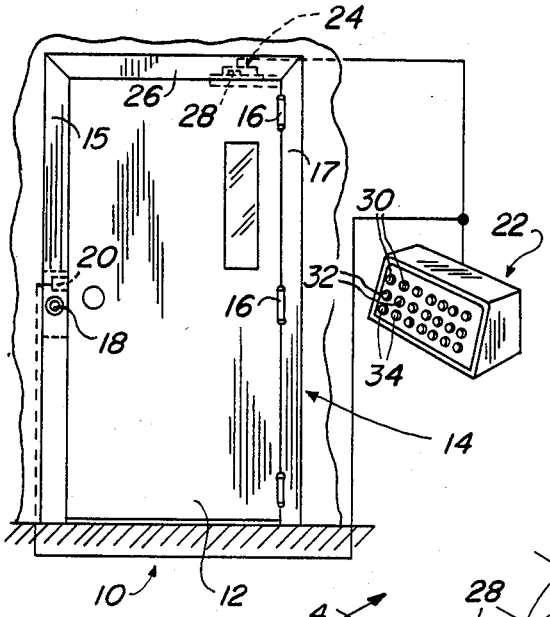
FIG. 1 is a schematic view of a security door installation embodying the present invention.
Figure 2:
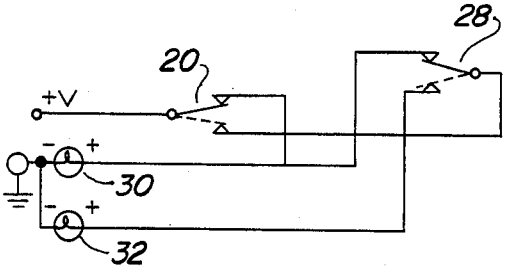
FIG. 2 is an electrical schematic of the arrangement of the monitoring switches used at the lock and adjacent the door headers.

Referring initially to FIGS. 1 and 2, a typical security door installation is illustrated, the overall installation being designated generally 10. In the illustrated embodiment 10, there is provided a door 12, a door frame 14, and hinges 16 which pivotally attach the door to one of the jambs 17 of the door frame. Mounted in the opposite jamb 15 is an electrically controlled lock assembly 18 which can be key operated from the exterior of the door, and is electrically controlled from the interior of the door by a button or switch. The purpose for this arrangement will become clear from the discussion to follow.

The lock assembly 18 includes a monitoring switch 20, shown diagramatically in FIG. 1, and in circuit convention form in FIG. 2. The switch 20 is normally biased to the condition as illustrated in FIG. 2 in full line (i.e. the door open condition), and is operated by the door 12 to the position illustrated in FIG. 2 in dotted line (i.e. the door-closed condition). The lock assembly 18, may be one of a number of known constructions but preferably is of the type illustrated in applicant's prior U.S. Pat. No. 4,237,711. The lock 18 includes the monitoring switch 20, which is electrically connected to a control panel 22 together with second switch 28 which is part of a door positioning monitoring assembly 24 in accordance with the invention.

This latter door position monitoring unit 24 is mounted in the header 26 of the door frame 14, as illustrated in dotted outline in FIG. 1. The construction of this assembly will be discussed in greater detail hereinafter with reference to FIGS. 3–8. However, for purposes of the present discussion, it should be noted that the unit 24 includes a switch 28 responsive to movement of the door to and from the fully closed position.

Referring again to FIG. 2, a partial schematic of the electrical wiring of switches 20 and 28 with the control panel 22 is shown. The aforementioned control panel includes a first series of indicator lights or lamps 30, one for each door being monitored, which lamps 30 when energized will indicate that the associated door 12 is open. Correspondingly, a second series of lights or lamps 32 are provided for indicating the door closed position for each door 12. Immediately below each set of lamps or lights 30 and 32 is a push-button switch 34 which is wired with the lock assembly 18 for a particular door in a well known manner, such that when the push-button switch is operated, the lock mechanism 18 will be rendered operational in response to a second push-button switch (not shown) located interiorly of the door.

With reference to FIG. 2, it can be seen that the switches 20 and 28 for a particular door are wired essentially in series with the corresponding lamp 32, with each switch normally biased to the full line position shown, and operated to the position indicated in dotted line by the door 12. It should be noted that before the "door-closed" lamp 32 can be energized, both switches 20 and 28 must be in the positions shown in dotted line. Even upon an attempt to manually operate switch 20, with the door slightly ajar, the switch 28 will remain in the position shown in full line to energize the door-open indicator lamp 30.

Thus, it can be appreciated that the sensitivity of the second door position monitor assembly 24 is important to the effective operation of the overall security system.

In this regard, the assembly 24 must not operate the switch 28 to the door-closed position (dotted line) until the door 12 is substantially fully closed or within less than two degrees (2°) of the fully closed position. If operation occurs sooner, an inmate can override the system. As will be discussed the door monitoring unit 24 of the present invention provides the necessary sensitivity to insure that the system cannot be overridden manually.

Looking to FIGS. 3–8, the construction of the monitoring assembly 24 will first be considered, and then the operation of this assembly 24 will be discussed. With regard to the overall construction, attention is first directed to FIG. 3, where it will be noted that the upper edge 42 of the door 12 has been recessed or mortised and a track assembly 45 disposed therein. A control arm 46 is provided and is slidably connected to the track 45 by a pin member 48. The opposite end of the control arm 46 is pivotally connected with respect to the remaining portion of the assembly 24 and is operatively coupled with the switch 28 in a manner to be discussed hereinafter.

Figure 3:
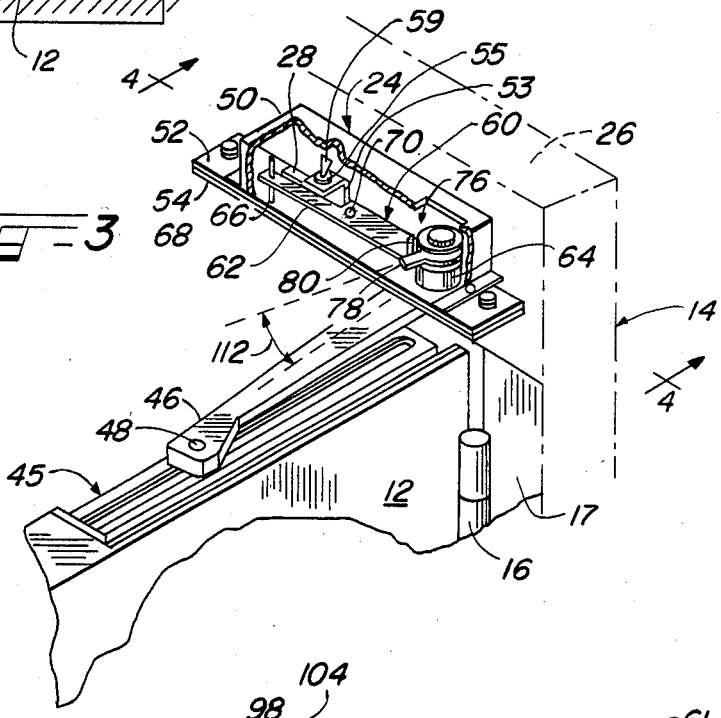
FIG. 3 is a perspective view of the door positioning monitoring arrangement of the present invention, with the control arm attached to the door, and the casing for the portion affixed to the door frame header partially broken away for clarity.

With continued reference to FIG. 3, the header portion 26 of the door frame is shown in dotted outline, and mounted thereto is the remaining portion of the monitoring assembly 24 to which the end of the control arm 46 is pivotally connected. This portion of the monitoring unit 24 normally includes housing 50, carried by a base plate 52, but for purposes of illustration the housing 50 has been partially broken away in FIG. 3. Also, it should be remembered that the entire functional portion of the monitoring unit 24 is contained and concealed within the metal header portion 26, access thereto being precluded by a panel or plate 54. Additionally, a suitable bracket 53 carries a wire strain relief member 55 for leading out the wires or conductors 59 of switch 28.

Returning to FIGS. 3–8, it can be seen that the functional portion of the monitoring unit 24 includes the base plate assembly 52, upon which is mounted the switch 28, preferably in the form of a conventional switch having a leaf spring-like operating arm 56. Movement of the operating arm 56 effects operation of a spring biased plunger 57 in conventional fashion so as to operate the switch 28 to and from the conditions or positions as diagramatically shown in FIG. 2. Also carried by the base plate 52 is a lever arm assembly or arrangement designated generally 60 which forms a part of the overall actuator means 61, FIG. 4, that provides the operative interconnection between the control arm 46 and the switch 28.

Figure 4:
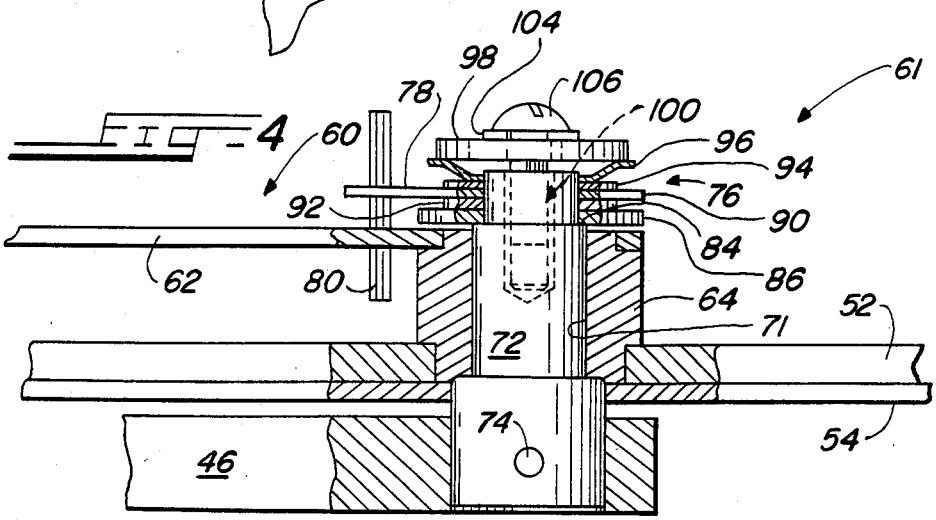
FIG. 4 is an enlarged view, patially broken away and partially in section taken generally in the plane of the line 4—4 of FIG. 3, illustrating the self-aligning or self-adjusting structure of the invention.
Figure 5:
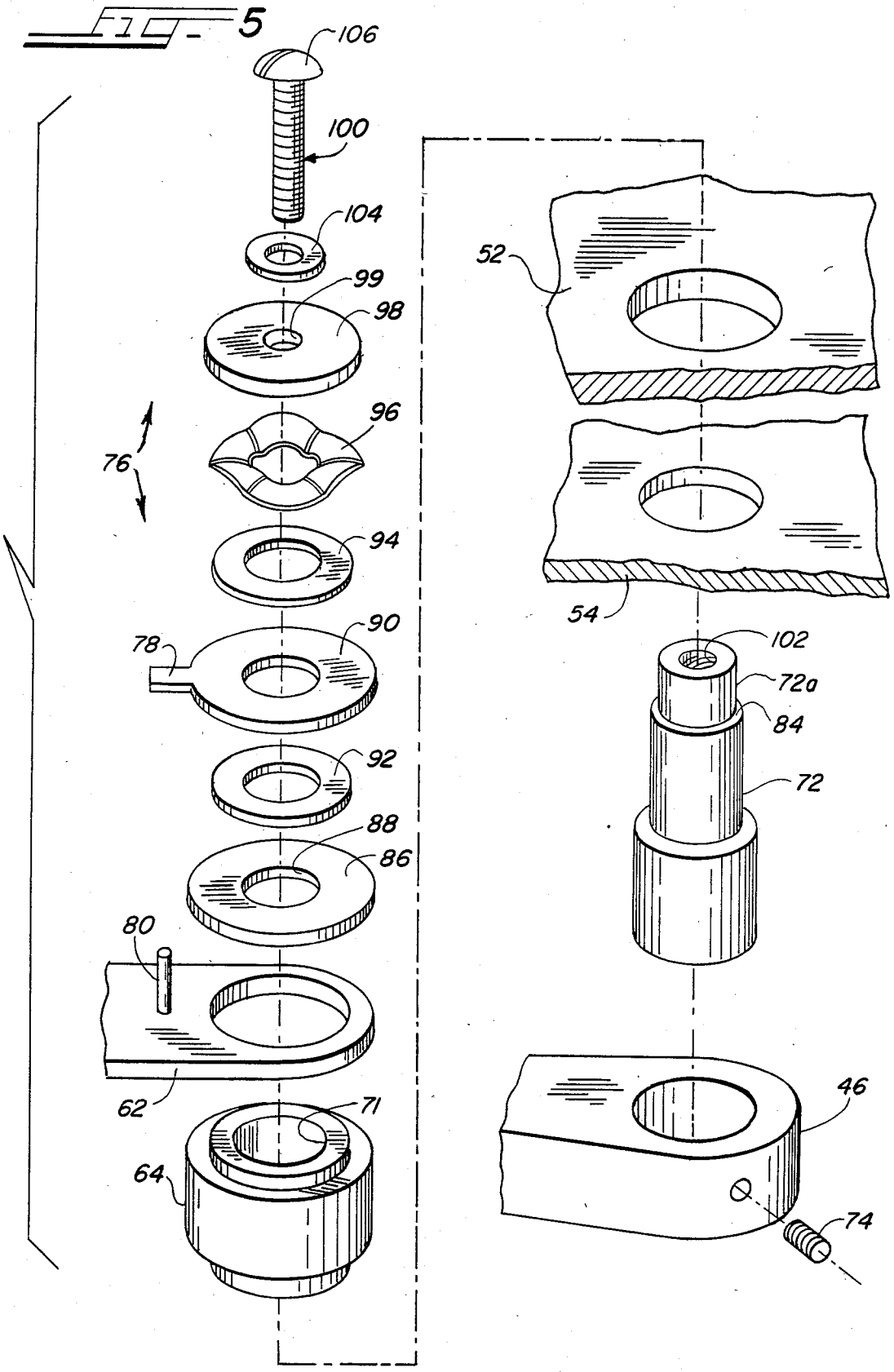
FIG. 5 is an exploded perspective view of the elements of FIG. 4, illustrating the construction thereof in greater detail.

Lever arm arrangement 60 includes a lever arm 62 which is pivotally mounted with respect to the base member 52 on a bearing block 64, as best seen in FIGS. 4 and 5. The lever arm 62 includes a pin 66 at the free end thereof which is engaged against the operating arm 56 of the switch 28. In addition, the lever arm 62 also includes a slot 68 engaged over a pin member 70 to comprise a stop which defines the limits of pivotal movement of the lever arm 62.

With continued reference to FIGS. 4 and 5, it will be noted that the bearing block 64 has a central aperture 71 in which there is rotatably disposed a shaft member 72, which shaft member 72 is non-rotatably connected to the operating arm 46 by a cross pin 74. Disposed on the upper end of the shaft 72 is an actuator assembly 76, which will be described in detail later. Suffice it to note at this point that the assembly, designated generally 76, and which includes a horizontally disposed, radially outwardly extending finger or protrusion 78, which, upon rotation of the control arm 46 will also rotate and produce movement of the lever arm 62. As noted above, it is movement of the lever arm 62 that produces operation of switch 28.

Figure 6:
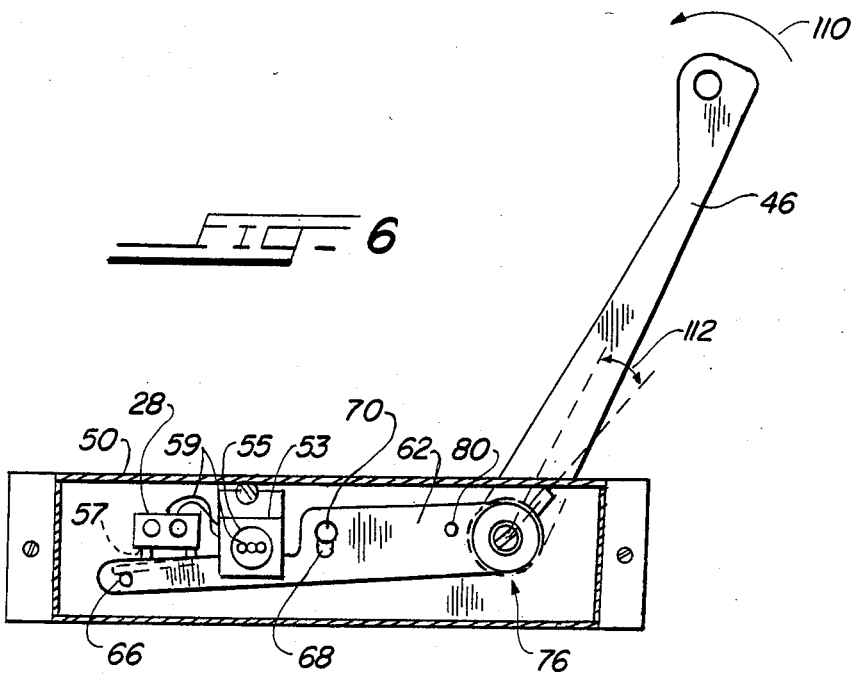
FIG. 6 is a partial top plan view illustrating a preferred method of presetting or pre-positioning the monitoring assembly of the invention to realize the self-adjusting or self-aligning features thereof.

The mounting of the shaft 72 with respect to the bearing block 64 is a rotative one, such that the control arm 46, shaft 72, and correspondingly, the actuator assembly 76 all normally pivot or rotate together relative to said bearing block 64. Also, the components of the actuator assembly 76 move relative to the lever arm 62, which as mentioned above, is pivotally supported on said bearing block 64. The lever arm 62 includes an additional upstanding pin member 80 disposed in the path of movement of the finger 78. Hence, these two members 78 and 80 define complementary abutment surfaces for imparting movement from the actuator assembly 76 to lever arm 62. Accordingly, as the actuator assembly 76 rotates, finger 78 will engage or abut pin 80, imparting clockwise movement to the lever arm 62 which in turn causes the pin 66 on the opposite end of said lever arm 62 to depress operating arm 56 and hence plunger 57 of switch 28. Thus, it can be seen that when finger 78 is not engaged with pin 80, the spring biased plunger 57 and spring-like operating arm 56 will tend to urge the lever arm 62 to the condition as shown in FIG. 6, which constitutes the normal biased condition for said arm and for the switch 28.

For a purpose which will become clear from the discussion that follows, the actuator assembly 76 is in the form of a slip-clutch type device. More specifically, the component part which carries the finger or protrusion 78 normally will rotate with the entire actuator assembly, however, when sufficient resistance is encountered relative movement or slippage can take place. As such the actuator assembly 76 provides the self-aligning means or feature discussed above.

Referring now to FIGS. 4 and 5, the preferred structure or component arrangement for actuator assembly 76 will now be described. It will be remembered that the shaft 72 is rotatably mounted with respect to the bearing block 64. Additionally, this shaft 72 has a reduced diameter upper end **72*a*, at the end thereof which protrudes upwardly of the bearing block 64 in FIG. 4. This reduced diameter portion defines a shoulder portion 84 over which is engaged a first flat washer member 86 which has a through aperture 88 of complementary shape for engaging the upper end 72*a* of shaft 72 and for abutting the shoulder 84. The abutment surface or finger 78 will be seen to be defined on or carried by a second washer-like member 90 which is held between two further washers 92 and 94. The washer members 92 and 94 preferably comprise fiber washers or washers comprised of some other compressible material for frictionally engaging therebetween the washer like member 90 carrying finger 78. To this end a suitable spring-like biasing member is provided in the form of a wave or spring washer 96 which in the illustrated embodiment is positioned upon the upper portion 72*a* of shaft 72 immediately above the upper fiber washer 94. An additional flat washer member 98 which preferably comprises a fender/plaster washer is positioned immediately above this wave washer 96. This latter washer 98 is provided with a through aperture 99 of complementary shape for receiving therethrough an externally threaded fastener member 100 which is utilized to hold together the foregoing assembly and impart a desired degree of compression thereto. In this regard, the upper end 72*a*** of shaft 72 is provided with a suitable complementary internally threaded and preferaby centrally disposed aperture 102 for threadably receiving the fastener 100. An additional spacer washer member 104 is also utilized in the illustrated embodiment for engaging the underside of the head portion 106 of the threaded fastener 100.

It will be appreciated that the foregoing assembly defines a frictional engagement for the finger -or abutment surface-carrying member 90 which is held by the foregoing structure intermediate the head 106 of fastener 100 and the opposing shoulder portion 84 of the shaft 72. Hence, in normal operation, the assembly including the protruding finger or abutment surface 78 generally rotates in unison with the shaft 72 and hence with the actuator arm 46 to which this shaft 72 is non-rotatably affixed. However, upon engagement with a fixed or non-movable surface, the finger or abutment surface 78 and the washer member 90 of which it is a part will rotate or slip relative to the shaft 72. That is, as soon as the force driving shaft 72 by way of actuator arm 46 overcomes the force of frictional engagement holding washer 90, rotation thereof relative to shaft 72 takes place.

Figure 7:
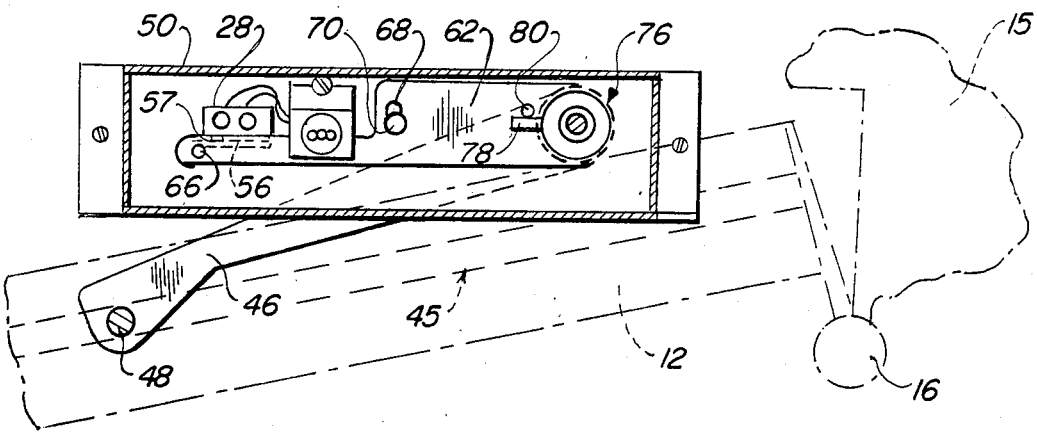
FIG. 7 is a view of the pre-positioned assembly of FIG. 6 upon initial closing of an associated door, immediately following installation of the assembly of the invention with the door and door frame.
Figure 8:
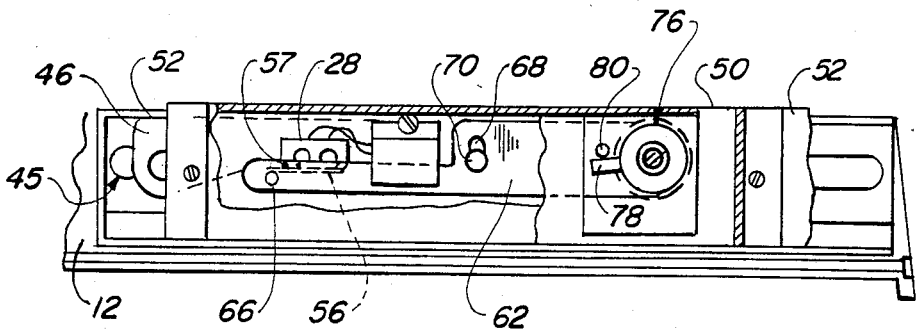
FIG. 8 is a top plan view, partially broken away, and similar to FIG. 6, illustrating the monitoring assembly of the invention with the associated door in a fully closed position.

Accordingly, and referring now to the remaining FIGS. 6, 7 and 8, in operation, the monitoring assembly 24 in accordance with the present invention may be readily and simply pre-set or pre-aligned for reliable operation in conjunction with any door and door frame assembly. This is achieved through employment of the slip-clutch type actuator assembly 76 as structurally described above, and as functionally described hereinafter. More specifically, referring to FIG. 6, either before monitoring assembly 24 is mounted to the header, or even after mounting, but before attachment of arm 46 to the door 12 a pre-adjusted operation is performed. In this regard, and with initial reference to FIG. 6, the monitoring assembly 24 is pre-set or pre-aligned and adjusted by the simple expedient of rotating the actuator arm 46 in the counter-clockwise direction as viewed and as generally indicated by the arrow 110 in FIG. 6. This causes the assembly 76 to be rotated together with shaft 72 as previously described, in the counter-clockwise direction as the arm 46 is rotated. As the protruding finger or abutment member 78 rotates in the counter-clockwise direction 110 it will eventually engage and abut an inner wall surface of the housing member 50. Thereupon, the finger 78 and associated member 90 will cease to rotate in unison with shaft 72 and arm 46 and slippage will occur between the member 90 and the remaining components of the actuator assembly 76. This results in an altering of the relative disposition of the finger 78 vis-a-vis arm 46. The degree of rotation imparted in this presetting operation is preferably such that the finger 78 defines some angle 112 with respect to the central axis of the arm 46. That is, the finger 78 is not in parallel alignment with the arm 46 but rather leads arm 46 by some angle 112 with respect to the direction of closing of door 12 relative to door frame 14 as shown for example in FIG. 3.

Once the above mentioned initial presetting operation is performed, the arm 46 may be affixed or attached to the track assembly 45 on the door 18. Accordingly, and referring now to FIG. 7, upon initial movement of the door 12 toward the closed position, the finger 78 will engage the complementary abutment surface or pin 80 somewhat ahead of the movement of the door 12. This in turn will cause movement of the lever arm 62 as previously described so as to achieve actuation of the switch 28, that is, full depression of leaf spring member 56 and plunger 57 as shown in FIG. 7. It is important to note that full depression of the switch 28 will occur before the door 18 reaches the fully closed position. At this point it also should be noted that the stop assembly, comprising pin 70 and slot 68, prevents further rotative movement of lever arm 62. Thus, upon further movement of the door toward its fully closed position, the corresponding further rotation of actuator arm 46 and shaft 72 will not cause further corresponding rotation of finger 78. Rather, the engagement of lever arm 62 with the stop 70 precludes movement of the arm 62, the pin 80 thereon and the finger 78 which is engaged against said pin 80. Accordingly, continued rotative movement of the door and arm 46 results in slippage of finger 78 and its associated washer-like member 90 with respect to shaft 72. That is, the normal frictional engagement provided by the actuator assembly 76 of FIG. 5 is now overcome by further rotative movement of shaft 72, whereby the assembly assumes the relative position thereof illustrated in FIG. 8 to which reference is now invited.

In FIG. 8, the door 12 is shown in its fully closed position, with finger 78 still engaged with pin 80 so as to hold lever arm 62 in its fully advanced position as defined by the stop pin 70. Also, the switch 28 is still in its fully actuated position as defined by engagement of pin 66 with the leaf spring-like arm 56 and depression of plunger 57 thereof. Thus, should the door 18 now be moved in the opening direction, that is away from the fully closed position of FIG. 8, the switch 28 will be operated from the door-closed position. Advantageously, the foregoing pre-setting or pre-aligning thus assures that the switch 28 will reliably be actuated upon the initial assembly with and closure of door 12. Moreover, with the parts in the alignment illustrated in FIG. 8, upon initial closure of door 12, the pre-alignment or pre-adjustment has now been accomplished such that but one or two degrees of movement of the door 12 toward its open position will now cause the switch 28 to be de-activated. This is true, since as previously described the finger 78 is unopposed for movement with shaft 72 in the door open direction. Hence, upon only a slight movement of the door 12 away from its fully closed position, it will be seen that the finger 78 will be released from engagement with the pin 80, permitting the normal spring-biased action of plunger 57 and arm 56 of the switch 28, as previously described, to return the switch to an open or unactuated position. In this regard, the lever arm 62 is preferably a relatively light weight, thin member, whereby the amount of biasing provided by the plunger 57 and spring-like arm 56 is sufficient to push the lever arm away from switch 28, for example as illustrated in FIG. 6.

From the foregoing, it will be appreciated that the relatively simple pre-adjustment or pre-alignment illustrated and described with reference to FIG. 6 requires no particular skills on the part of the installer and no tools whatsoever. Accordingly, upon this relatively simple adjustment, operation of the switch 28 in response to movement of the door 12 in the fashion previously described is assured, upon installation of the assembly 24 with any door and door frame assembly. Hence, relative variations in the relative location, configurations of parts or the like does not adversely affect proper operation of the security assembly 24 in accordance with the invention. This is true of variations which may occur in the relative parts and alignment from one security assembly 24 to another or from one door and door frame assembly 10 to another. Moreover, it will be appreciated that this pre-adjustment assures proper operation additionally without regard for variations which may occur in the parts of door 10 and frame 14 or their alignment due to wear, warpage, or the like, while in service.

While a particular embodiment of the invention has been shown and described in detail, it will be apparent to those skilled in the art that changes and modifications of the present invention, in its various aspects, may be made without departing from the invention in its broader aspects. As such, it is not intended that the scope of the invention be limited by the paticular embodiment and specific construction described herein, but rather be defined by the appended claims and equivalents thereof. Accordingly, the aim in the appended claims is to cover all such changes and modifications as fall within the true spirit and scope of the invention.

The invention is claimed as follows:

1. A door position monitoring assembly for a security door installation including a door having a vertical edge hingedly mounted to a door frame, said monitoring assembly comprising: switching means capable of being operated to attain a first condition and a second condition, each of which conditions can be detected by suitable circuit means; and control arm having one end thereof coupled for movement with said door; pivot means for pivotally mounting said control arm proximate the other end thereof such that movement of said door upon said hinged mounting thereof will produce pivotal movement of said control arm relative to said pivot means; and acutator means for operatively coupling pivotally mounted end of the control arm with the switching means such that when the door is open said switching means will be in said first condition, rotation of said control arm upon movement of the door to a substantially closed position producing said second condition of said switching means and initial movement of the door away from said substantially closed position permitting said switching means to return to said first condition; and wherein said actuator means includes self-aligning means automatically positionable prior to commencing installation of said monitoring assembly such that upon initial movement of said door from said open position to a fully closed position, said operation of said switching means in response to further movement of said door is assured, substantially without regard to manufacturing or installation irregularities or to variations occurring while in service, in the relative proportions, positioning or alignment of said door installation, said switching means, said control arm or said actuator means, wherein said actuator means further includes, lever arm means having one end freely pivotally mounted at said pivot means and mounted for operative engagement with said switching means proximate an opposite end thereof, stop means for limiting pivotal movement of said lever arn in either direction, and abutment means engageable with said lever arm means; said self-aligning means comprising mounting means for said abutment means which includes relatively movable spring-biased components biased into engagement with the abutment means such that the abutment means will normally pivot in unison with the control arm to engage and pivot the lever arm, said spring-biased components permitting relative slippage of the abutment means with respect to said control arm upon engagement of the lever arm means with said stop means, thereby permitting said control arm and said abutment means to attain a properly aligned relationship through movement of the control arm.

2. An assembly according to claim 1 wherein said switching means is carried by a base member mounted to said stationary surface, and wherein said pivot means is also mounted to said base member.

3. An assembly according to claim 1 wherein said switching means includes a spring biased member engaged with said lever arm means, with movement of said spring biased member in response to movement of said lever arm means operating said switching means to said first and second conditions.

4. An assembly according to claim 3 wherein said spring biased member normally biases said lever arm means in a first direction for operating said switching means to said first condition and is yieldable in response to pivotal movement of said lever arm in a direction opposite said first direction for operating said switching means to said second condition.

5. An assembly according to claim 1 wherein said switching means comprises a leaf-spring actuated micro-switch; said leaf-spring portion thereof being engaged with said lever arm means.

6. An assembly according to claim 1 wherein said mounting means comprises friction disc means engaged with said abutment means and compression means for compressing said friction disc means against said abutment means.

7. An assembly according to claim 6 wherein said pivot means comprises a pivotally movable shaft member non rotatably engaged with said control arm: and wherein said abutment means comprises a disc-like member frictionally engaged with said friction disc means and a protruding abutment portion for engagement with said lever arm means.

8. An assembly according to claim 6 wherein said compression means comprises a shoulder portion formed in said pivot means, a compressibly deformable member, and fastener means having a head portion and advanceable with respect to said shaft means for compressibly engaging said deformable compression member, said abutment member and said friction disc means intermediate said head portion and said shoulder portion.

9. A door position monitoring assembly for a security door installation including a door having a vertical edge hingedly mounted to a door frame, said monitoring assembly comprising: a base member; switching means capable of being operated to attain a first condition and a second condition, each of which conditions can be detected by a suitable circuit means; a control arm having on end thereof coupled for movement with said door and the other end pivotally mounted to said base member; and actuator means operatively coupling said pivotally mounted end of the control arm with the switching means such that when the door is open said switching means will be in said first condition, rotation of said control arm upon movement of the door to a substantially closed position producing said second condition of said switching means and initial movement of the door away from said substantially closed position permitting said switching means to return to said first condition, said actuator means further including self-aligning means positionable prior to commencing installation of said monitoring assembly for automatically presetting said actuator means such that upon initial movement of said door from said open position to a fully closed position, said operation of said switching means in response to further movement of said door is assured, to thereby assure operation thereof in conjunction with any given door installation without regard for variations in the door installation.

10. A monitoring assembly according to claim 9 wherein said actuator means further includes, a lever arm having a free end engageable with said switch means, an abutment member normally pivotable with said control arm for engaging said lever arm to produce movement of said free end of the lever arm, said self-aligning means including slip-clutch means mounting said abutment member for movement with the control arm and permitting relative slippage of the abutment member with respect to the control arm, thereby enabling the relative position of the control arm and abutment member to be properly aligned through movement of the control arm.

11. A monitoring assembly according to claim 10 wherein said abutment member comprises a washer shaped member having a finger extending radially therefrom, and said slip clutch means comprises at least one friction disc member engaged with said abutment member, and a biasing member for compressing said friction disc member against said abutment member.

12. A monitoring assembly according to claim 11 further including a pivot member carried by said control arm and extending through the base member, said pivot member having said lever arm, said abutment member and said slip clutch means mounted thereon.

13. An assembly according to claim 10 wherein said switching means includes a spring biased member engaged with said lever arm means, with movement of said spring biased member in response to movement of said lever arm means operating said switching means to said first and second conditions.

14. An assembly according to claim 13 said spring biased member normally biases said lever arm means in a first direction for operating said switching means to said first condition and is yieldable in response to pivotal movement of said lever arm in a direction opposite said first direction for operating said switching means to said second condition.

* * * * *